US009768551B2

(12) United States Patent
Schafmeister et al.

(10) Patent No.: US 9,768,551 B2
(45) Date of Patent: Sep. 19, 2017

(54) PLUG-TYPE CONNECTOR

(71) Applicant: PHOENIX CONTACT GMBH & CO. KG, Blomberg (DE)

(72) Inventors: Arndt Schafmeister, Doerentrup (DE); Ralf Geske, Schieder-Schwalenberg (DE); Ralf Gehle, Detmold (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 14/917,276

(22) PCT Filed: Sep. 3, 2014

(86) PCT No.: PCT/EP2014/068753
§ 371 (c)(1),
(2) Date: Mar. 8, 2016

(87) PCT Pub. No.: WO2015/036305
PCT Pub. Date: Mar. 19, 2015

(65) Prior Publication Data

US 2016/0226191 A1 Aug. 4, 2016

(30) Foreign Application Priority Data

Sep. 10, 2013 (DE) ..... 10 2013 109 933

(51) Int. Cl.
*H01R 13/633* (2006.01)
*H01R 9/03* (2006.01)
(Continued)

(52) U.S. Cl.
CPC ..... *H01R 13/6335* (2013.01); *H01R 9/034* (2013.01); *H01R 13/6581* (2013.01); *H01R 13/6592* (2013.01); *H01R 13/74* (2013.01)

(58) Field of Classification Search
CPC .... H01R 9/034; H01R 13/74; H01R 13/6335; H01R 13/6581; H01R 13/6592; H01R 13/6485; H01R 13/6596; H01R 33/97
(Continued)

(56) References Cited

U.S. PATENT DOCUMENTS 5,288,241 A * 2/1994 Davidge ..... H01R 13/60 439/133
5,418,330 A 5/1995 Rook
(Continued)

FOREIGN PATENT DOCUMENTS

DE 2324548 A 12/1973
DE 4214508 A1 11/1993
(Continued)

OTHER PUBLICATIONS

Translation of EP 2107648, Oct. 7, 2009.*

*Primary Examiner* — Tulsidas C Patel
*Assistant Examiner* — Travis Chambers
(74) *Attorney, Agent, or Firm* — Leydig, Voit & Mayer, Ltd.

(57) ABSTRACT

An electrical plug-type connector has a housing for holding electrical plug elements, and a pulling aid made of an electrically insulating material, which enables the plug-type connector to be pulled apart from a mating connector, and which protrudes from the housing of the plug-type connector in the form of a tab. The pulling aid is provided with an electrically conductive portion which is designed and provided as a screening support for the screening of an electrical lead that is to be connected to the electrical plug-type connector.

19 Claims, 8 Drawing Sheets

(51) Int. Cl.
*H01R 13/6592* (2011.01)
*H01R 13/6581* (2011.01)
*H01R 13/74* (2006.01)

(58) Field of Classification Search
USPC ..... 439/160, 95, 96, 101, 133, 304, 939
See application file for complete search history.

(56) References Cited

U.S. PATENT DOCUMENTS 6,135,818 A * 10/2000 Lang ..... H01R 13/6592 439/607.41
7,128,605 B2 * 10/2006 Montena ..... H01R 13/6397 439/133
7,264,507 B2 * 9/2007 Beckman ..... H01R 12/7047 439/564
7,510,439 B2 * 3/2009 Gordon ..... H01R 13/6589 439/607.41
7,632,125 B2 * 12/2009 Irwin ..... G02B 6/3879 385/76
8,112,879 B2 * 2/2012 Morrison ..... H01R 13/5213 29/426.5
8,323,042 B2 * 12/2012 Lin ..... H01R 13/443 439/133
8,672,694 B2 * 3/2014 Lee ..... H01R 13/443 439/133
8,672,709 B2 * 3/2014 Dietz ..... H01R 13/74 439/352
2002/0173203 A1 11/2002 Cisey
2006/0068639 A1 * 3/2006 Barringer ..... H01R 13/65802 439/607.01
2006/0105632 A1 * 5/2006 Szczesny ..... H01R 9/032 439/607.41
2006/0209509 A1 9/2006 Hetzer et al.
2012/0171888 A1 7/2012 Dietz

FOREIGN PATENT DOCUMENTS

DE 4216422 A1 11/1993
DE 20021610 U1 3/2001
DE 20318084 U1 4/2005
DE 102005012370 B3 6/2006
DE 202008004428 U1 8/2009
DE EP 2107648 A1 * 10/2009 ..... H01R 9/034
DE 102008034113 A1 2/2010
DE 202010000741 U1 7/2010
DE 202012007584 U1 8/2012
DE 102012013434 A1 * 12/2013 ..... H01R 13/58
GB 1439176 A 6/1976

* cited by examiner

PLUG-TYPE CONNECTOR

CROSS-REFERENCE TO RELATED APPLICATIONS

This application is a U.S. national stage application under 35 U.S.C. §371 of International Application No. PCT/EP2014/068753, filed on Sep. 3, 2014, and claims benefit to German Patent Application No. DE 10 2013 109 933.5, filed on Sep. 10, 2013. The International Application was published in German on Mar. 19, 2015, as WO 2015/036305 A1 under PCT Article 21(2).

FIELD

The invention relates to an electrical plug-in connector.

BACKGROUND

A plug-in connector may comprise a housing for receiving electrical connector elements, by means of which electrical contact with a mating connector can be produced, and a removal aid made of an electrically insulating material, by means of which the plug-in connector can be removed from a mating connector and which projects from the housing of the plug-in connector in the form of a tab. A removal aid of this type makes it easier to remove the plug-in connector from a mating connector, in particular in environments that are difficult to access. To achieve this, the removal aid projecting from the housing of the plug-in connector is gripped and the plug-in connector is removed from the mating connector by a suitable tensile force being (manually) exerted on the removal aid. It is therefore not necessary to grip the housing of the plug-in connector itself in order to be able to remove said connector from the mating connector. Moreover, in confined installation situations, any attempt to remove the plug-in connector from the mating connector by exerting a tensile force on the associated connection cable is in particular prevented, which attempt could result in the connection between the plug-in connector and the associated connection cable being damaged. The removal aid therefore simultaneously acts as strain relief for the cable.

However, the arrangement of such a removal aid on the plug-in connector can be incompatible with the requirement for a shield support to be provided on the plug-in connector, on which the shield of the connection cable associated with the plug-in connector is placed in order to impose a defined potential on said cable (potential equalization) as described in DE 20 2010 000 741 U1.

SUMMARY

An aspect of the invention provides an electrical plug-in connector, comprising: a housing configured to receive one or more electrical connector elements; and a removal aid including an electrically insulating material, wherein the removal aid is configured for removing the plug-in connector from a mating connector, wherein the removal aid projects from the housing in the form of a tab, and wherein the removal aid includes an electrically conductive portion in the form of a shield support for a shield of an electrical connection cable to be connected to the electrical plug-in connector.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
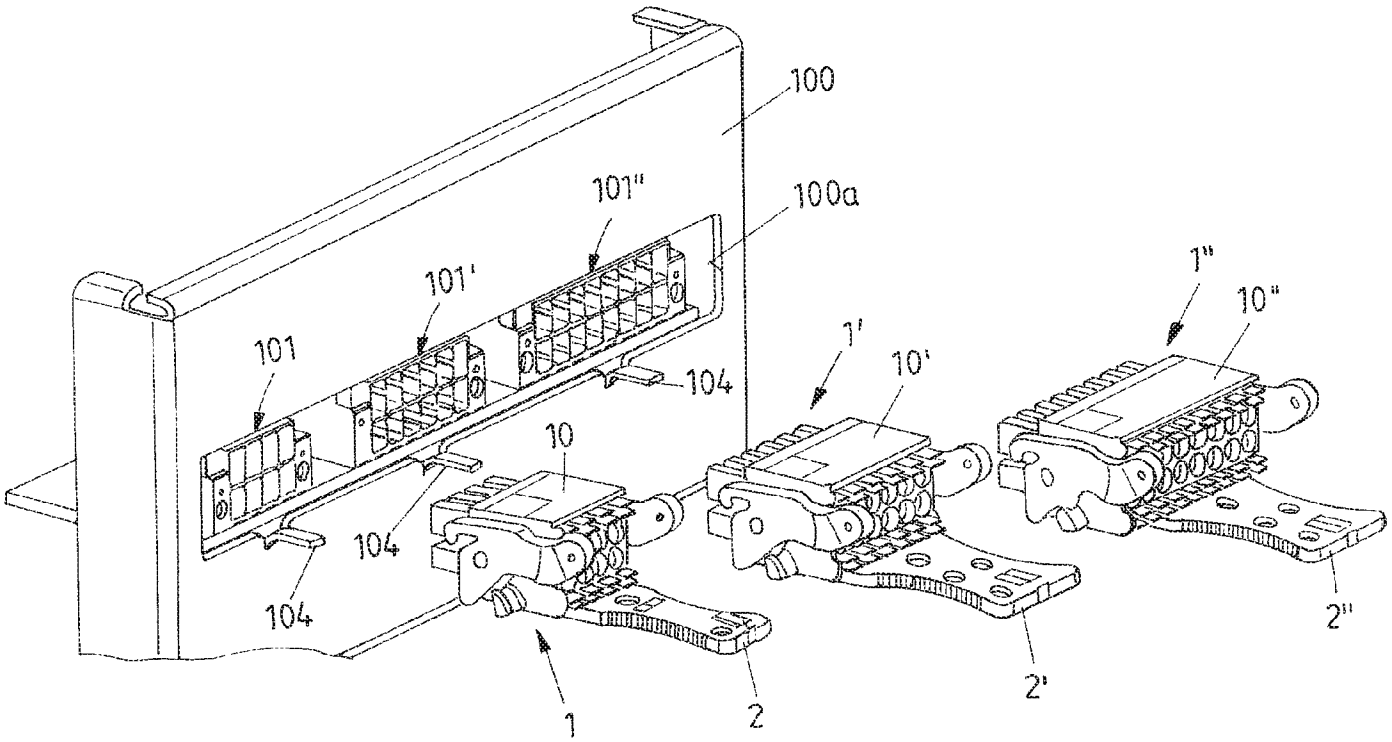
FIG. 1 is a perspective view of a plurality of plug-in connectors that are each associated with one mating connector respectively.

An aspect of the invention provides an improved plug-in connector comprising a removal aid.

In a plug-in connector, the removal aid is provided with an electrically conductive portion that is designed and provided as a shield support for the shield of an electrical connection cable associated with the plug-in connector.

An embodiment according to the invention involves recognizing that a shield support can therefore be advantageously integrated in a removal aid because the removal aid can be specifically designed such that those regions of the removal aid that act as gripping regions for gripping the removal aid, and those regions of the removal aid on which the shield support is provided can be (spatially) separated from one another.

It is therefore advantageous to provide the shield support in a region of the removal aid that faces the connection cable leaving the housing of the plug-in connector so that reliable electrical contact between the cable shield and the shield support can easily be produced. Conversely, with regard to the gripping regions, in which the removal aid can be gripped by a user, it is expedient to arrange said regions on those regions of the removal aid that are not directly facing the connection cable in order to make it easier for the removal aid to be gripped by a user and in order to prevent accidental pulling on the connection cable.

Therefore, an aspect of the invention results in a simplified design of a plug-in connector, in which the removal aid and the shield support form one component, without this leading to restrictions in terms of the function of the removal aid or of the shield support.

The electrically conductive portion acting as the shield support may for example be secured to the removal aid in an interlocking manner. For this purpose, the electrically conductive portion can be able to be inserted into an associated fastening region of the removal aid and/or can engage a fastening region of the removal aid from behind and/or grip around said region. Alternatively or additionally, it may be provided for the electrically conductive portion to be secured to the removal aid in a non-positive and/or bonded manner.

Specifically, the electrically conductive portion may be a plate that is secured to the removal aid, and therefore defines an electrically conductive surface portion on the removal aid that acts as the shield support.

The removal aid itself may be formed in a single piece on the housing of the plug-in connector or may be secured thereto as a separate component. Plastics material, for example, is a suitable material for the removal aid.

The removal aid advantageously comprises at least one gripping region at which the removal aid can be gripped in order to (manually) exert a tensile force thereon, by means of which the plug-in connector can be removed from a mating connector so as to break the plug connection. A gripping region of this type is preferably formed in a region of the removal aid which faces away from a connection cable connected to the plug-in connector as intended in order to make it easier to grip the removal aid and in order to, in addition, avoid accidental pulling on the connection cable. For this purpose, a particular gripping region can be formed as a recessed handle for example, which optionally has a rippled surface and that extends laterally on the removal aid. In particular, two gripping handles may be provided, one on each of two opposite sides of the removal aid, the electrically conductive surface portion acting as the shield support advantageously being positioned between the two gripping handles in such a way that the shield of an electrical cable connected to the plug-in connector as intended is supported on said surface portion.

Furthermore, electrically conductive connection means are provided on the removal aid, by means of which the electrically conductive portion of the removal aid acting as the shield support can be connected to an electrically conductive body in order to thereby create potential equalization between the shield of the connection cable associated with the plug-in connector and said body. In this case, these connection means may be an (electrically conductive) wall that has a cutout through which the plug-in connector can be connected to a mating connector, it being possible for said mating connector to be secured to said wall. Owing to the connection between the shield of the connection cable associated with the plug-in connector and said wall, which is produced by means of the shield support on the plug-in connector and the connection means provided therefor, a defined potential equalization can be brought about between the shield and said wall.

The connection means, by means of which the electrical connection between the shield support and a further (electrically conductive) body, e.g. a wall, is intended to be produced, can have different designs. One possibility is to produce a flexible connection by means of an electrical cable. Another possibility is to produce a plug connection between the shield support and the further body, in particular at the same time as connecting the plug-in connector to a mating connector. Furthermore, electrical contact can also be produced at fastening points at which the plug-in connector is to be fastened to said body.

A removal aid designed according to an aspect of the invention for an electrical plug-in connector is characterized by being made of an electrically insulating material and which, when arranged as intended on the plug-in connector, projects therefrom in the form of a tab so that the plug-in connector can be removed from a mating connector by means of the removal aid, wherein the removal aid is provided with an electrically conductive portion which is designed and provided as a shield support for the shield of an electrical connection cable to be connected to the electrical plug-in connector.

In addition, an aspect of the invention relates to an electrical plug connection to an electrical plug-in connector.

FIG. 1 shows a plug arrangement comprising three plug-in connectors 1, 1', 1", each of which is associated with one mating connector 101, 101', 101" respectively, shown in the unconnected state. Each of the plug-in connectors 1, 1', 1" is provided in order to be plugged into one of the mating connectors 101, 101', 101". For this purpose, the plug-in connectors 1, 1', 1" and the associated mating connectors 101, 101', 101" each comprise connector elements that correspond to one another, e.g. in the form of connector pins on the plug-in connectors 1, 1', 1" and connector sockets that receive the connector pins on the mating connectors 101, 101', 101".

In the present case, the mating connectors 101, 101', 101" are arranged on a wall 100, e.g. a wall of an apparatus, acting as an electrically conductive (e.g. metal) body such that the connector face of a particular mating connector 101, 101', 101" faces a cutout 100*a* in the wall 100, through which a particular mating connector 101, 101', 101" can be connected to the associated plug-in connector 1, 1', 1" and can be electrically contacted thereto.

Furthermore, the present case relates to the embodiment of the plug-in connectors 1, 1', 1" which each comprise a housing 10, 10', 10" comprising removal aids 2, 2', 2" arranged thereon. This embodiment is described in more detail in the following on the basis of the example of one of the plug-in connectors (1) with reference to FIG. 2A, possible variants of said plug-in connector being shown in FIG. 4A to 8A. FIGS. 3A and 3B show details in the region of the removal aid of a plug-in connector that is provided with a shield support.

Figure 2A:
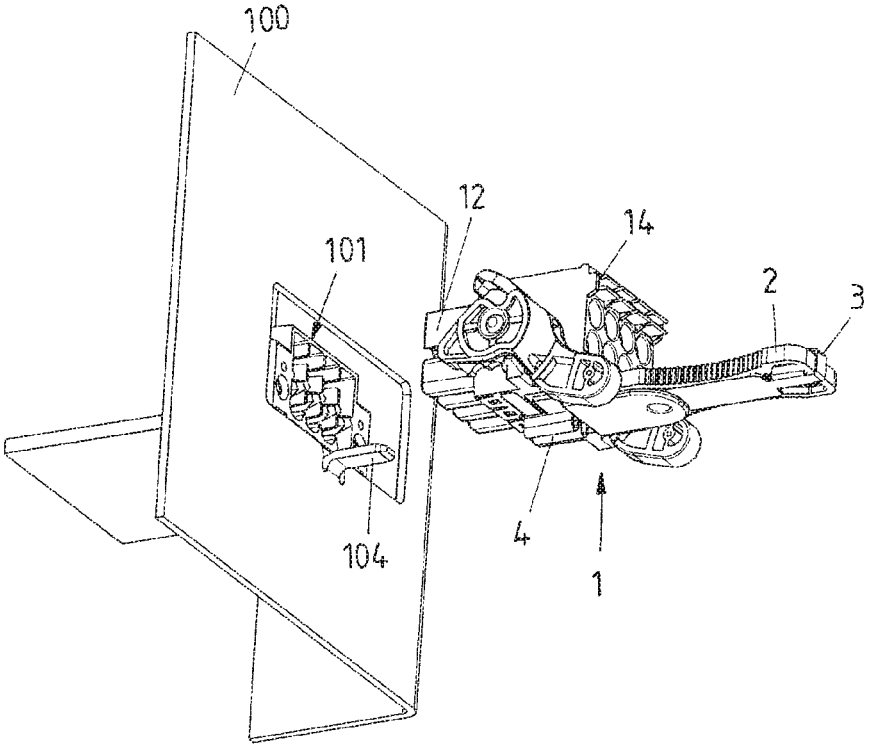
FIG. 2A is an enlarged perspective view of the plug-in connector from FIG. 1 and the associated mating connector.
Figure 3A:
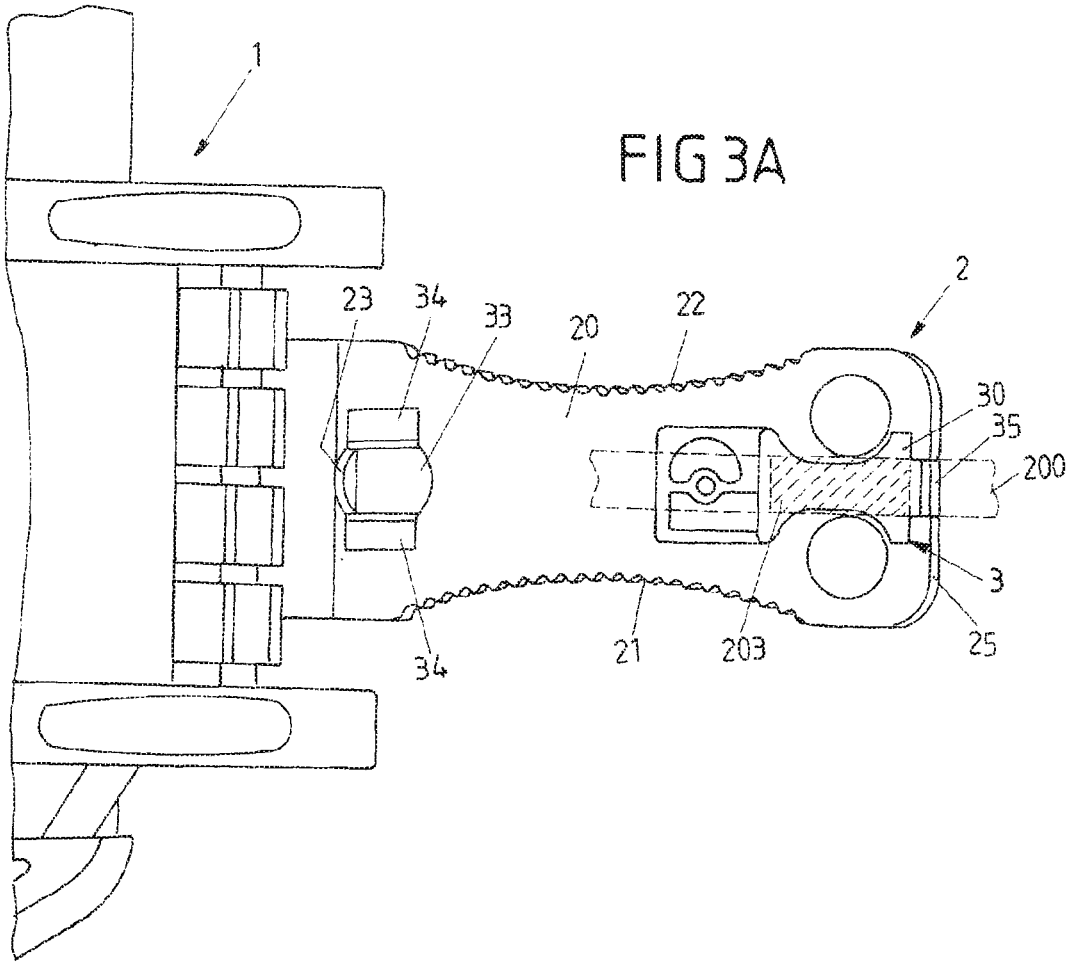
FIG. 3A is a plan view of a removal aid for a plug-in connector.
Figure 3B:
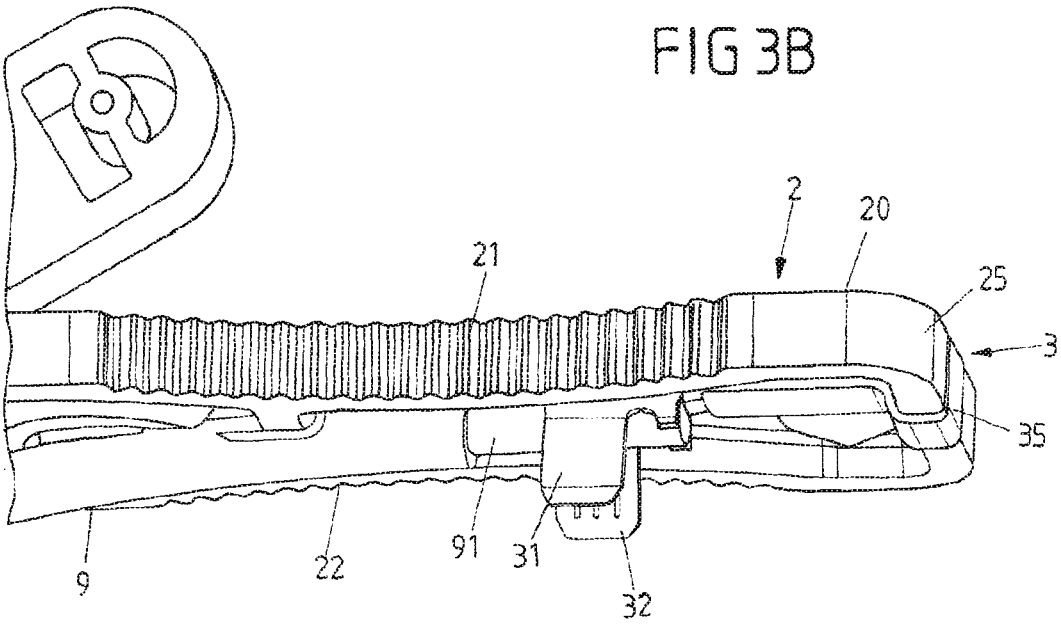
FIG. 3B is an oblique view from below of a removal aid.

FIG. 2A shows a plug-in connector 1, the wall 100 and a mating connector 101 that is arranged behind a cutout in the wall 100 and is associated with the plug-in connector 1, in a plug arrangement of the type shown in FIG. 1.

The plug-in connector 1 comprises a housing 10, the front side 12 of which is designed as a plug face comprising connector elements, which in this case are in the form of connector pins, by means of which the plug-in connector 1 can be connected to the mating connector 101 associated therewith. In the present case, this occurs specifically by introducing the connector elements on the front side 12 of the plug-in connector 1 into socket contacts of the mating connector. The rear side 14 of the plug-in connector housing 10 is designed as an electrical connection region, by means of which an electrical connection cable can be connected to the plug-in connector 1.

Figure 2B:
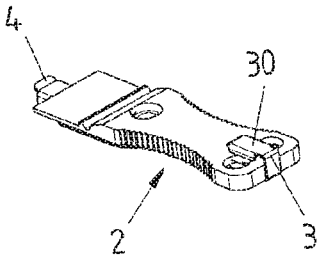
FIGS. 2B and 2C show two views of a removal aid of the plug-in connector from FIG. 2A.
Figure 2C:
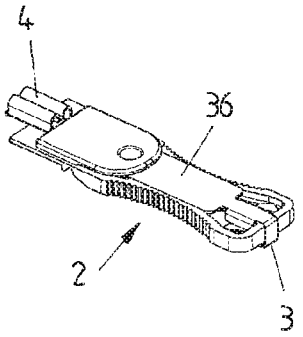

Furthermore, a removal aid 2 projects from the plug-in connector 1, specifically from the rear side of the connector housing 10, which removal aid is, in this case, designed as a tab that can be seen in more detail in a plan view in FIG. 3A. Two additional views of the removal aid 2 are shown in FIGS. 2B and 2C. The removal aid 2 is intended to allow the plug-in connector 1 to be removed from the associated mating connector 101 when the two connector parts 1, 101 are interconnected. To achieve this, a user grips the removal aid 2 and exerts a tensile force thereon which removes the plug-in connector 1 from the mating connector 101. So that the removal aid 2 can be gripped easily, it comprises gripping regions 21, 22 that are each in the form of a (rippled) gripping handle. The two gripping regions 21, 22 are arranged so as to be opposite one another, one on each side of the removal aid 2.

The removal aid 2 consists of an electrically insulating material, in particular a plastics material. Said removal aid can be formed in a single piece on the housing 10 of the plug-in connector 1 or be secured thereto as a separate component, e.g. by an adhesive, a screw connection or latched connection. In the first case, adhesive surfaces associated with one another are provided on the plug-in connector 1 and on the removal aid 2. In the last case, latch elements that are associated with and can engage with one another are provided on the plug-in connector 1 and on the removal aid 2.

In the present case, the removal aid 2 is arranged on the plug-in connector 1 such that a connection cable connected to the connection region on the rear side 14 of the connector housing 10 as intended extends along a side of the removal aid 2 that faces away from said cable. For this purpose, in the embodiment the removal aid 2 projects from the connector housing 10 adjacently to the connection region on the rear side 14 of said connector housing. According to FIG. 2A, the removal aid 2 is specifically arranged directly below the region for connecting an electrical cable that is provided on the rear side 14 of the connector housing 10. This means that the side of the removal aid 2 that faces the connection cable can act as a support for said connection cable.

In the present case, in a dual use of the removal aid 2, an electrically conductive portion 3 is provided on the side of said removal aid that faces a connection cable (connected to the plug-in connector 1 as intended) according to FIGS. 2A, 2B, 2C and 3A, which portion forms, together with a surface portion 30, a shield support for the connection cable. Owing to the fact that the shield of a connection cable connected to the plug-in connector 1 as intended rests on said surface portion 30, the shield of the connection cable can be electrically conductively connected thereby to a further body, e.g. the wall 100, for the purpose of potential equalization.

A portion of a connection cable 200 connected to the plug-in connector 1 resting, by means of the shield 203 thereof, on the electrically conductive portion 3 of the removal aid 2 (shield support), or more specifically on said surface portion 30 in the embodiment, is shown schematically in FIG. 3A.

The electrically conductive portion 3 acting as the shield support may in particular consist of metal. In the present case, said portion is formed by a plate.

In the embodiment, an interlocking connection is used for securing the electrically conductive portion 3 to the removal aid 2. Therefore, a first fastening portion 33 projecting from the electrically conductive portion 3 is guided through a fastening opening 23 in the removal aid 3 and the angular ends 34 of said portion engage said aid from behind on the edge thereof. A further fastening portion 35 projecting from the electrically conductive portion 3 grips around the removal aid 2 at the free end 25 thereof; see also FIG. 3B.

In order to connect the shield of an electrical cable, connected to the plug-in connector 1 as intended, to the wall 100 by means of the shield support provided on the removal aid 2, i.e. by means of the electrically conductive portion 3, a connection means is required, by means of which the electrically conductive portion 3 can be electrically contacted to said wall 100.

According to the embodiment shown in FIGS. 1 and 2A, there are tabs 104 projecting from the wall 100, which, in the present case, are formed from the material of the wall 100 and which each form an electrical contact element that is assigned to one particular plug-in connector 1, 1', 1" when said plug-in connector is connected to the associated mating connector 101, 101', 101" as intended. In this case, the tabs 104 each project from the wall 100 towards the plug-in connector, and therefore point away from the mating connectors 101, 101', 101".

Accordingly, an electrical (metal) mating contact 4 is arranged on the plug-in connector 1, specifically on the housing 10 thereof, more specifically on the removal aid 2; cf. FIGS. 2B and 2C, which mating contact is electrically connected to the electrically conductive portion 3 acting as the shield support by means of an electrical connection portion 36, e.g. by an integral connection. Therefore, the portion 3 acting as the shield support, and the mating contact 4, can be formed by the same plate. The same applies to the additional embodiments described in the following with reference to FIG. 4A to 7C. The mating contact 4 rests on the contact element (in the form of a tab 104) on the wall when the plug-in connector 1 is connected to the associated mating connector 101. As a result, by means of the electrically conductive portion 3 acting as the shield support, the mating contact 4 and the contact element 104 on the wall, an electrically conductive connection between the shield of a cable connected to the plug-in connector 1 and the wall 100 can be produced.

Figure 8A:
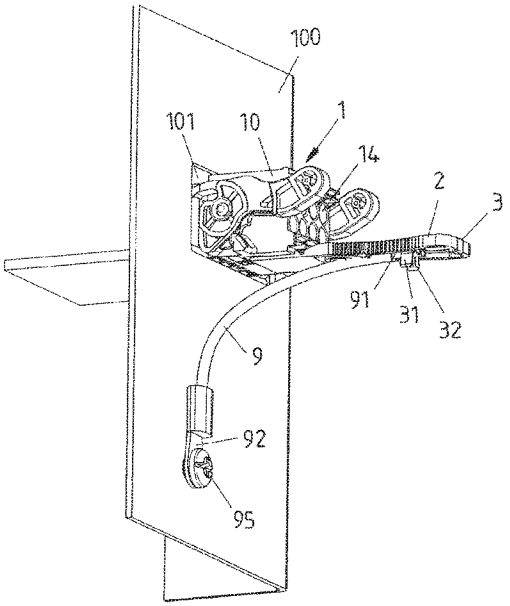
FIG. 8A shows a fifth variant of the plug-in connector from FIG. 2.
Figure 8B:
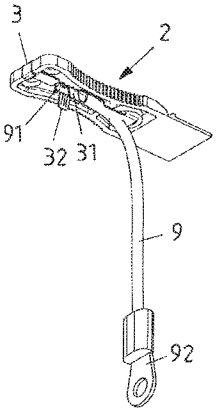
FIGS. 8B and 8C are two views of the removal aid of the plug-in connector from FIG. 8A.
Figure 8C:
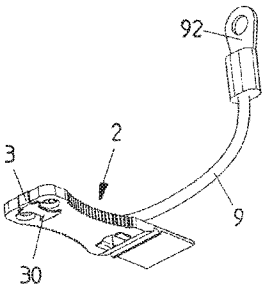

Different variants for the possible means for contact described with reference to FIGS. 1 and 2 are shown in FIG. 4A to 7C. The possibility of an electrical connection by means of a connection cable is shown in FIG. 8A to 8C in conjunction with FIG. 3B.

First of all, the variants shown in FIG. 4A to 7C of the possible means for contact explained with reference to FIGS. 1, 2A, 2B and 2C will be described, corresponding elements in FIGS. 4A and 7C being provided with the same reference numerals as in FIGS. 1, 2A, 2B and 2C, and then only the differences from FIGS. 1, 2A, 2B and 2C will be explored in each case.

Figure 4A:
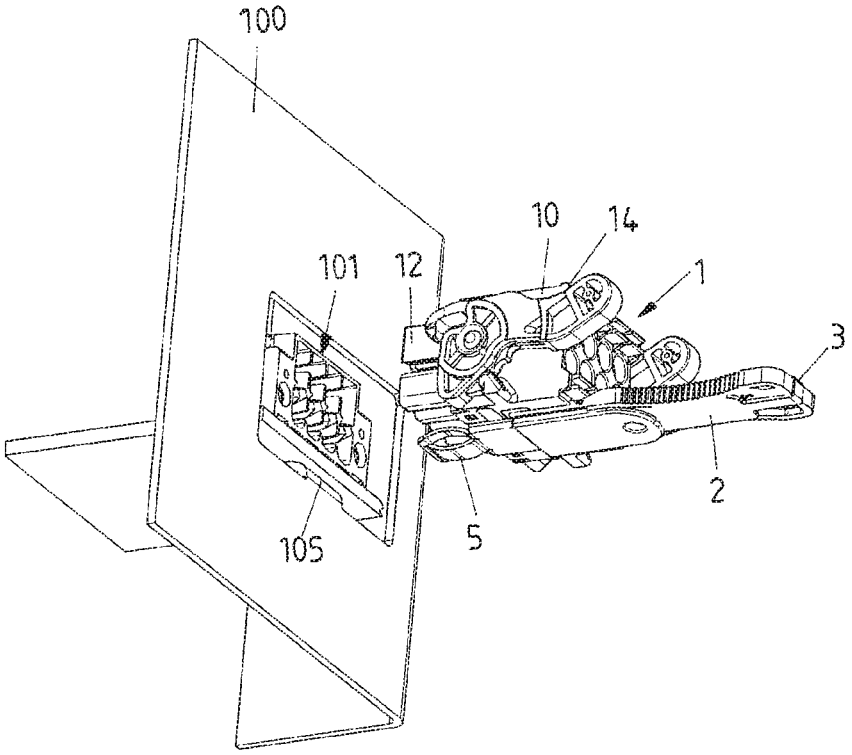
FIG. 4A shows a first variant of the plug-in connector from FIG. 2.
Figure 4B:
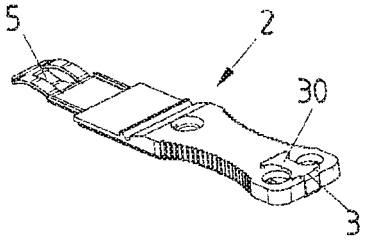
FIGS. 4B and 4C are two views of the removal aid of the plug-in connector from FIG. 4A.
Figure 4C:
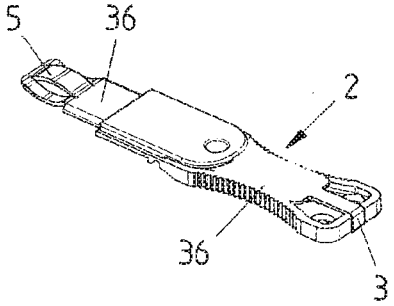

According to the embodiment shown in FIG. 4A, the tabs 105 formed on the wall 100 and acting as contact elements on the wall point away from the respective associated plug-in connectors (e.g. 1) and instead point towards the corresponding mating connectors (e.g. 101). The relevant tab 105 projects from the edge of the cutout 100*a* in the wall 100. A spring mating contact 5 is provided on the plug-in connector 1 or on the removal aid 2, which contact is electrically connected to the portion 3 acting as the shield support; c.f. the single depiction of the removal aid 2 in FIGS. 4B and 4C, and projects from the plug-in connector 1 or the housing 10 thereof so as to rest in a resiliently biased manner on the associated contact element on the wall (tab 105) when the plug-in connector 1 is connected to the mating connector 101 as intended.

Figure 5A:
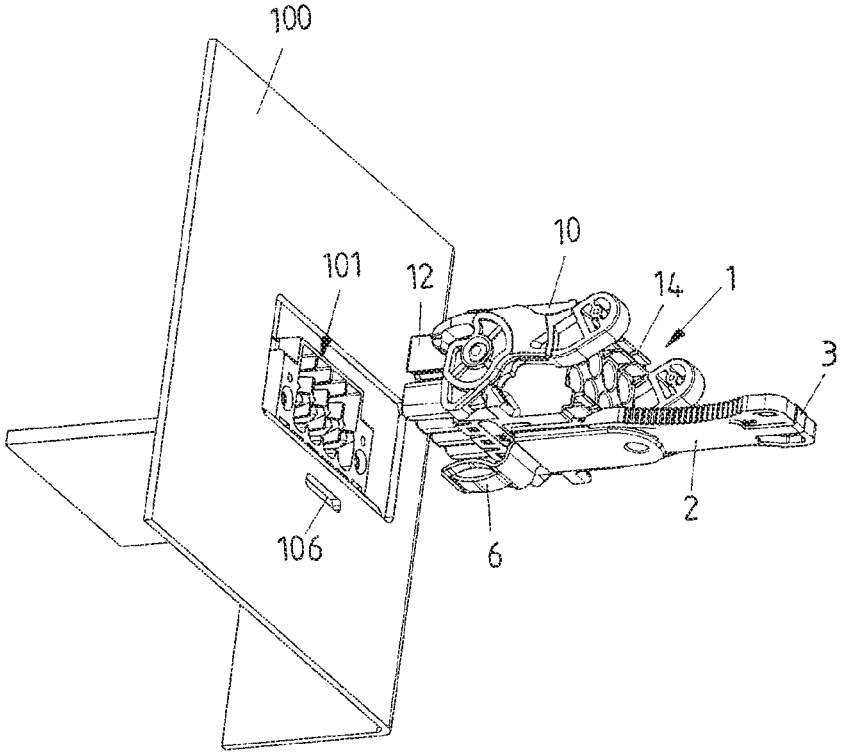
FIG. 5A shows a second variant of the plug-in connector from FIG. 2.
Figure 5B:
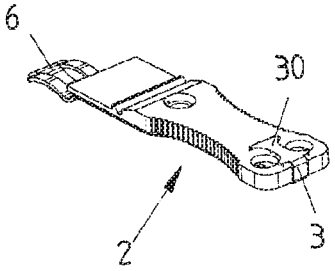
FIGS. 5B and 5C are two views of the removal aid of the plug-in connector from FIG. 5A.
Figure 5C:
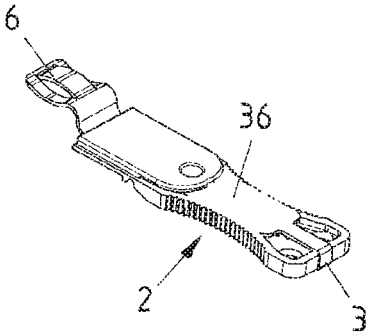

In the embodiment of FIG. 5A, the contact element on the wall is formed as a contact opening 106 in the wall 100, which is in turn associated with a resilient mating contact 6 on the plug-in connector, which is electrically connected to the portion 3 acting as the shield support; cf. the single depiction of the removal aid 2 in FIGS. 5B and 5C. The resilient mating contact 6 projects from the plug-in connector 1, specifically from the removal aid 2, such that it engages with the contact opening 106 in the wall when the plug-in connector 1 is connected to the mating connector 101 as intended. As a result, the resilient mating contact 6 is biased at the edge of the contact opening 106 in the wall, and so there is reliable electrical contact.

Figure 6A:
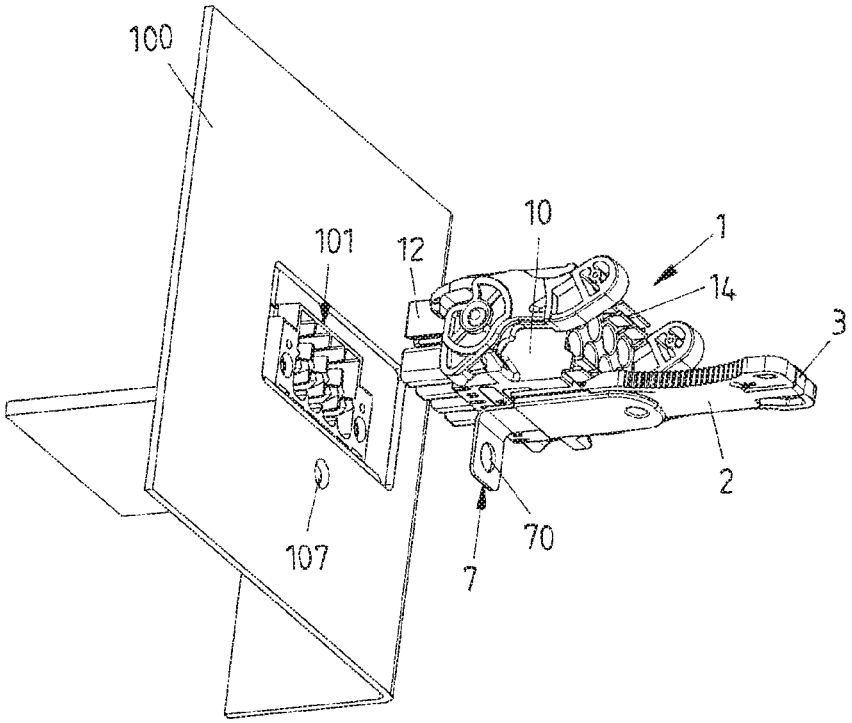
FIG. 6A shows a third variant of the plug-in connector from FIG. 2.
Figure 6B:
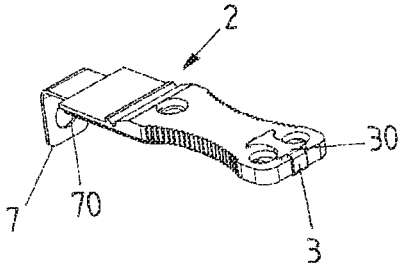
FIGS. 6B and 6C are two views of the removal aid of the plug-in connector from FIG. 6A.
Figure 6C:
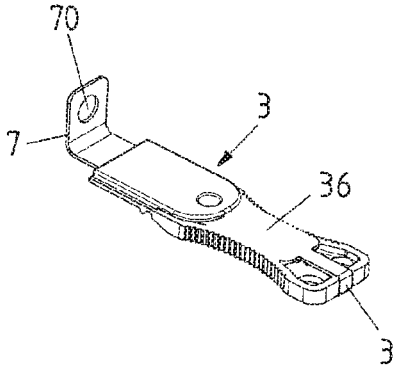

In the embodiment of FIG. 6A, a contact element on the wall in the form of a contact opening 107 is designed as a fastening point (fastening opening) which is associated with a mating contact 7 on the plug-in connector 1 in the form of a further fastening opening in a metal fastening portion 70, which, in turn, is connected to the portion 3 acting as the shield support in an electrically conductive manner; cf. the single depiction of the removal aid 2 in FIGS. 6B and 6C. When bringing the plug-in connector 1 together with the mating connector 101 as intended, the two fastening openings 7, 107 overlap and can be clamped together by suitable fastening means, e.g. in the form of a screw or a clip, so that the metal fastening portion 70 that surrounds the fastening opening in the plug-in connector and that defines the mating contact 7 is electrically connected to the wall 100.

Figure 7A:
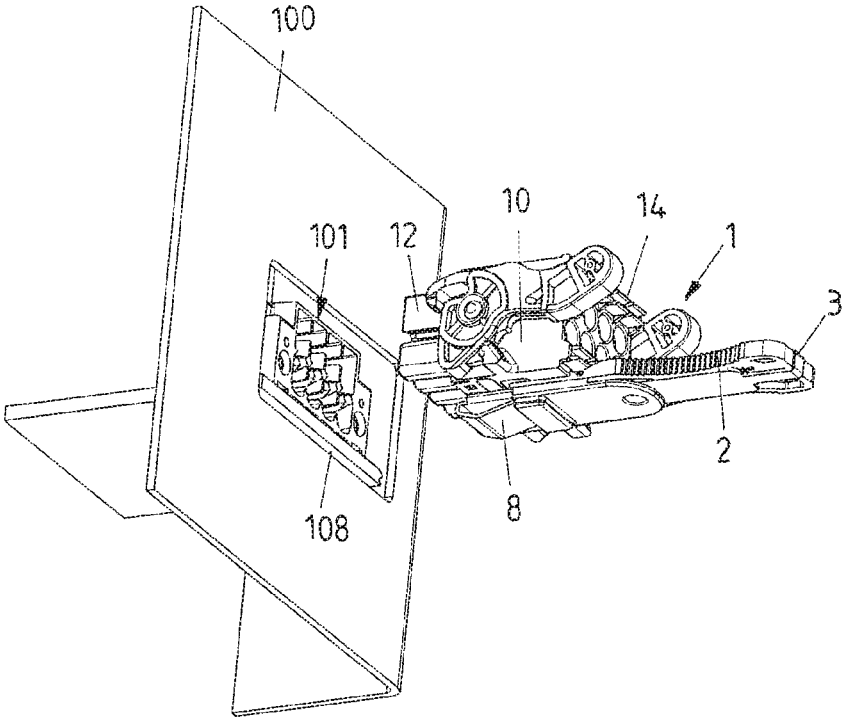
FIG. 7A shows a fourth variant of the plug-in connector from FIG. 2.
Figure 7B:
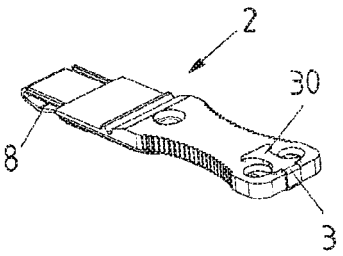
FIGS. 7B and 7C are two views of the removal aid of the plug-in connector from FIG. 7A.
Figure 7C:
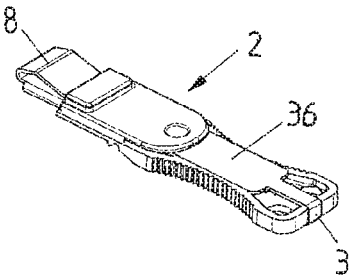

According to FIG. 7A, a contact opening is again provided as a contact element 108 on the wall that, in the present case, is formed on the edge of the cutout 100*a* in the wall. The contact opening 108 in the wall is associated with a resilient mating contact 8 on the plug-in connector 1, specifically the removal aid 2, which is electrically conductively connected to the portion 3 acting as the shield support; cf. the single depiction of the removal aid 2 in FIGS. 7B and 7C. The resilient mating contact 8 is designed such that it rests on the edge of the contact opening 108 facing away from the cutout 100*a* when the plug-in connector 1 and the mating connector 101 have been brought together as intended.

An embodiment of a plug-in connector is shown in FIG. 8, and also with additional reference to FIGS. 3B, 8B and 8C, in which the electrical connection between the portion 3 acting as the shield support on the removal aid 2 and a further electrically conductive body, which in the present case is the wall 100, is produced by means of an electrical connection cable 9. As can be seen in FIGS. 3B, 8B and 8C, one end of the connection cable 9 is electrically connected to the portion 3 acting as the shield support by means of a (stripped) end portion 91. For this purpose, the end portion 91 of the cable 9 engages, in the embodiment, between two contact tabs 31, 32 of the electrically conductive portion 3 acting as the shield support.

A metal fastening portion 92 is provided at the other end of the cable 9 at the wall, by means of which the connection cable 9 can be fastened to the wall 100 by means of suitable fastening means 95, e.g. in the form of a screw, the metal fastening portion 92 being clamped against the wall 100. As a result, the fastening portion 3 on the removal aid 2 acting as the shield support and a further electrically conductive body in the form of the wall 100 are electrically connected as desired.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

The invention claimed is:

1. An electrical plug-in connector, comprising:

a housing configured to receive one or more electrical connector elements; and a removal aid including an electrically insulating material, wherein the removal aid is configured for removing the plug-in connector from a mating connector, wherein the removal aid projects from the housing in the form of a tab, wherein the removal aid includes an electrically conductive portion in the form of a shield support for a shield of an electrical connection cable to be connected to the electrical plug-in connector, and wherein the electrically conductive portion is secured to the removal aid in an interlocking manner in that the electrically conductive portion includes at least one fastening portion that grips around a region of the removal aid.

2. The connector of claim 1, wherein the electrically conductive portion forms a surface portion on a first side of the removal aid that faces the connection cable when the connection cable is connected to the plug-in connector.

3. The connector of claim 1, wherein the electrically conductive portion is a panel.

4. The connector of claim 1, wherein the removal aid includes a plastic material.

5. The connector of claim 1, comprising the connection cable that is connected to the plug-in connector and includes the shield, wherein the shield rests on the electrically conductive portion of the removal aid.

6. An electrical plug connection, comprising;

the plug-in connector of claim 1; and the mating connector, wherein the plug-in connector and the mating connector are interconnected through a cutout in an electrically conductive body, and wherein the electrically conductive portion of the plug-in connector is electrically connected to the electrically conductive body.

7. The connector of claim 1, wherein the removal aid includes a gripping region which faces away from the connection cable associated with the plug-in connector when the connection cable is connected to the plug-in connector.

8. The connector of claim 7, wherein the gripping region is configured as a recessed handle.

9. The connector of claim 1, further comprising:

electrical connectors, wherein, using the electrical connectors, the electrically conductive portion, including a metal portion, provided on the removal aid, can be contacted to a different electrically conductive body from the electrical plug-in connector for potential equalization.

10. The connector of claim 9, wherein at least one of the electrical connectors includes an electrical mating contact which can be brought into electrical connection with a contact element provided on the electrically conductive body when the plug-in connector is connected to the mating connector.

11. The connector of claim 9, wherein at least one of the electrical connectors includes a resilient electrical mating contact that can rest, in a resiliently biased manner, on a contact element provided on the electrically conductive body.

12. The connector of claim 9, wherein at least one of the electrical connectors includes an electrically conductive fastening point at which electrically conductive contact to a fastening point provided on the electrically conductive body can be produced.

13. The connector of claim 9, wherein at least one of the electrical connectors includes an electrical cable, wherein, using the electrically conductive portion, including a metal portion, provided on the removal aid, can be connected to the electrically conductive body.

14. The connector of claim 1, wherein the removal aid is secured to the plug-in connector using a fastener.

15. The connector of claim 14, wherein the removal aid is secured to the plug-in connector using an adhesive, a latched connection, or a screw connection.

16. A removal aid of an electrical plug-in connector, the removal aid comprising:

an electrically insulating material, wherein, the removal aid is disposable on the plug-in connector, so as to project from the plug-in connector in the form of a tab, so that the plug-in connector can be removed from a mating connector using the removal aid, wherein the removal aid includes an electrically conductive portion in the form of a shield support for a shield of an electrical connection cable to be connected to the electrical plug-in connector, and wherein the electrically conductive portion is secured to the removal aid in an interlocking manner in that the electrically conductive portion includes at least one fastening portion that grips around a region of the removal aid.

17. The removal aid of claim 16, configured so as to be secured to the plug-in connector using an adhesive, a latched connection, or a screw connection.

18. The removal aid of claim 16, wherein the electrically conductive portion forms a surface portion on a first side of the removal aid that faces the connection cable when the connection cable is connected to the plug-in connector.

19. A method of securing a removal aid to a plug-in connector, the method comprising:

contacting the removal aid of claim 16 to the plug-in connector such that the plug-in connector, supplemented by the removal aid, can be removed from the mating connector using the removal aid.

* * * * *